United States Patent [19]

Georgiev

[11] 4,300,874

[45] Nov. 17, 1981

[54] ROTARY MACHINE WITH LENTICULAR ROTOR AND A CIRCULAR GUIDE MEMBER THEREFOR

[75] Inventor: Georgi D. Georgiev, Toronto, Canada

[73] Assignee: Capella Inc., Freeport, The Bahamas

[21] Appl. No.: 108,675

[22] Filed: Dec. 31, 1979

Related U.S. Application Data

[63] Continuation-in-part of Ser. No. 914,952, Jun. 12, 1978, abandoned.

[51] Int. Cl.[3] ..... F01C 1/02; F01C 21/08; F03C 2/02; F04C 2/02

[52] U.S. Cl. ..... 418/54; 418/150

[58] Field of Search ..... 418/54, 61 A, 150

[56] References Cited

U.S. PATENT DOCUMENTS

| | | | |
|---|---|---|---|
| 1,340,625 | 5/1920 | Planche | 418/54 |
| 1,846,557 | 2/1932 | Imshenetsky | 418/150 |
| 1,952,834 | 3/1934 | Beidler et al. | 418/150 |
| 4,061,445 | 12/1977 | Doshi | 418/54 |

FOREIGN PATENT DOCUMENTS

| | | | |
|---|---|---|---|
| 258 | of 1853 | United Kingdom | 418/54 |
| 1241841 | 8/1971 | United Kingdom | 418/150 |

*Primary Examiner*—John J. Vrablik

*Attorney, Agent, or Firm*—George A. Rolston; William F. Frank

[57] ABSTRACT

A rotary machine particularly intended for use as a pump comprises a two-lobe lenticular rotor rotatably disposed within a pump chamber defined by an annular wall with an inner surface having at least in part a cardioidal configuration. A rectangular drive plate on a shaft is disposed within an elongated drive slot in the rotor while a circular guide disc fixed on an end wall of the pump casing extends into a second elongated guide slot in the rotor. The second guide slot is perpendicular to the first slot so that, during operation, the rotor effectively reciprocates and rotates relative to the guide disc. If desired, two such circular guide discs can be provided, one on each end wall of the pump casing, for reciprocation and rotation relative to two such second guide slots in opposite faces of the rotor.

18 Claims, 9 Drawing Figures

ROTARY MACHINE WITH LENTICULAR ROTOR AND A CIRCULAR GUIDE MEMBER THEREFOR

This is a continuation-in-part of application Ser. No. 914,952, filed June 12, 1978 entitled "ROTARY MACHINE WITH LENTICULAR ROTOR" now abandoned.

The present invention relates to rotary machines and more particularly to a rotary machine comprising a two-lobe lenticular rotor rotably disposed within a machine chamber having an annular wall with an inner surface having at least in part a cardioidal configuration.

BACKGROUND OF THE INVENTION

Various rotary machines which include rotors rotable within cylindrical chambers have heretofore been proposed. Many such machines previously suggested have chambers of generally cylindrical configurations and have presented certain serious design problems. It is necessary, in such a machine, to provide seals at the ends of the rotor, which seals are longitudinally retractable and extensible relative to the rotor, to accommodate the variable distances between the apices or lobes of the rotor and the cylindrical chamber wall.

Other rotary machines and particularly rotary engines, have heretofore been proposed and provided with chambers having epitrochoidal configurations, of complex design creating other more serious problems.

It is an object of this invention to provide a rotary machine, and particularly a pump, having a movel structure and in which many of the disadvantages presented by the machines heretofore known are avoided or at least minimized.

Other objects of the invention will become apparent as the description herein proceeds.

SUMMARY OF THE INVENTION

The present invention comprises a rotary machine which in turn comprises, a casing including a chamber defined by axially spaced apart end walls and a single lobe annular wall with an inner surface having at least in part a cardioidal configuration;

a shaft extending into such chamber, rotatably mounted in at least one of said end walls and comprising, within said chamber, an acircular portion having mutually parallel and linear opposite edges;

a two-lobe lenticular rotor with symmetrically opposed apices and disposed within said chamber for eccentric rotation therein with said apices in sliding sealing contact with said inner surface of said annular wall, said rotor being provided with a first elongated slot having opposite sides within which said acircular portion of said shaft is slidingly disposed for reciprocating movement therewithin on rotation of said shaft and, in an end surface thereof, with a second elongated slot having parallel opposite sides and perpendicular to said first elongated slot;

a fixed circular guide member on the inner face of a said end wall of said casing and extending into said second elongated slot within said rotor so that, on the rotation of said rotor within said chamber, said opposite sides of said second elongated slot move tengentially around said guide member in response to relative reciprocating movement of said guide member along said second elongated slot with at least a semi-circular part of said circular guide member remaining within said second elongated slot at all times during such rotation of said rotor; and mutually spaced inlet and outlet ports opening into said chamber for the supply and discharge respectively of a fluid material.

If desired, a rotary machine in accordance with this invention can be provided with two such fixed circular guide members, one on each of the end walls of the casing, such circular guide members being mutually co-axial and extending into corresponding ones of a pair of said second elongated slots provided in respective ones of said end surfaces of said rotor. In such a construction, the shaft will extend through both the circular guide members.

The fixed circular guide member provided in a rotary machine in accordance with this invention can be a separate member or can be integrally formed with one of the end walls of the casing. The first elongated slot will normally have generally rectangular configuration and the second elongated slot will normally have semi-cylindrical ends.

In accordance with one embodiment of this invention, the inner surface of the annular wall of the casing of a rotary machine in accordance therewith has a completely cardioidal configuration, which can be defined by either of the following polar equations:

$$r=E(\sin\theta)^n+R$$

and $$r=(R+E)-E(\cos\theta)^n$$

wherein r represents the length of the line extending from the centre of said shaft to a position on said cardioidal surface when such line subtends an angle $\theta$ with an imaginary base line defining a minimum area of one side of said base line and a maximum area on the other side of said base line between said base line and the inner surface of said annular wall;

E is a positive constant indicative of the eccentricity of said inner surface of said annular wall and equal to the distance between the centre of the shaft and the centre of the circular guide member; and R represents half the length of said rotor, between said apices thereof.

In such equations, n usually has a value of 1.0 and the ratio R:E preferably has a value greater than 2:1.

In accordance with an alternative embodiment of this invention, one portion of the inner surface of the annular wall of the machine casing comprises a circular arc having a radius $r_1$ and extending between the ends of an imaginary base line extending through the center of its shaft and defining a minimum area on one side of said base line and a maximum area on the other side of said base line between said base line and the inner surface of the annular wall. In such an alternative embodiment, the inner surface of the annular wall of the casing on the opposite side of such base line to the circular arc portion is defined by the polar equation:

$$r_3=2R-r_2$$

wherein:

$r_3$ represents the length of a line extending from the centre of the shaft to a position on the inner surface of the annular wall on a side of the base line opposite to the circular arc portion when such line subtends an angle $\theta$ with the base line, and $r_2$ represents the absolute value of the length of a line extending from the centre of the shaft to a position on the circular arc portion of the inner surface of the annular wall when such last-mentioned line subtends an angle of $(180°+\theta)$ with such base line.

For such a surface configuration, the parameters $r_1$, $r_2$ and $r_3$ are related by the following equations:

$$r_1 = \frac{R^2 - R.E. + E^2/2}{(R - E)}\text{; and}$$

$$r_2 = \frac{E(R - E/2)\cdot \sin\theta}{(R - E)} + \left(\frac{E^2(R - E/2)^2 \sin^2\theta}{(R - E)^2} + R^2\right)^{\frac{1}{2}}$$

wherein:

E represents a positive constant indicative of the eccentricity of said inner surface of the annular wall on the opposite side of said base line to said circular arc portion and equal to the distance between the centre of the shaft and the centre of the circular guide member; and R represents half the length of the rotor between the apices thereof.

In this embodiment of the invention, the ratio R:E preferably has a value greater than 2:1.

The various features of novelty which characterize the invention are pointed out with particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

BRIEF DESCRIPTION OF THE DRAWINGS

The invention will now be described merely by way of illustration with reference to the accompanying drawings in which.

DESCRIPTION OF THE PREFERRED EMBODIMENTS

Figure 1:
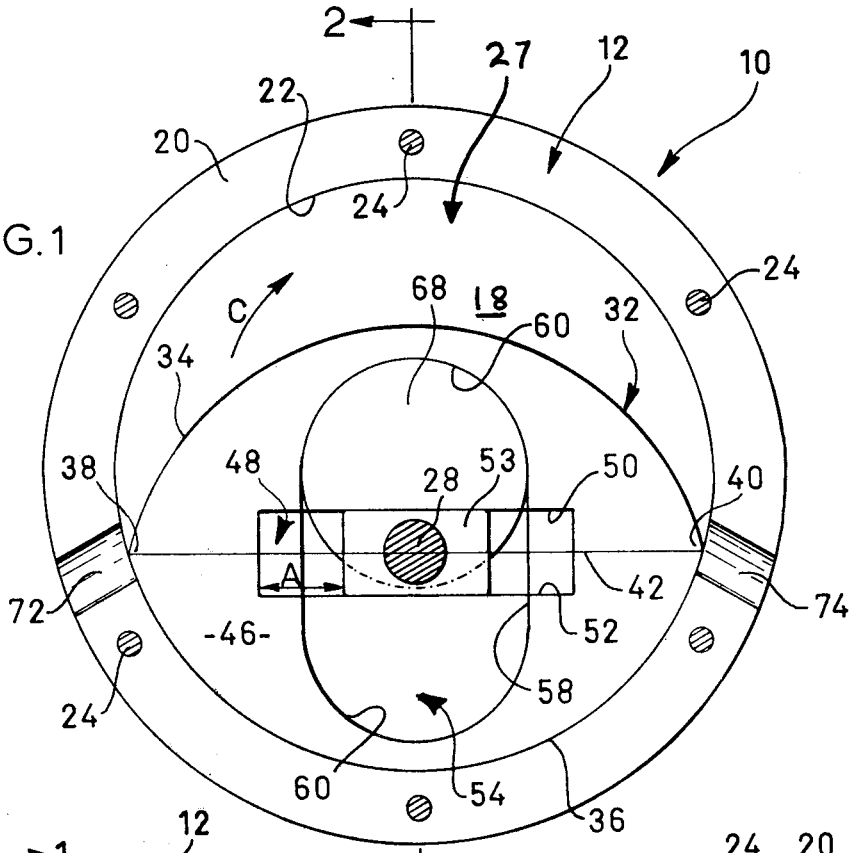
FIG. 1 is a somewhat schematic sectional elevation of one embodiment of a rotary machine in the form of a pump in accordance with this invention, showing the rotor of that pump in one angular position thereof and taken as indicated by the arrows 1—1 of FIG. 2.
Figure 2:
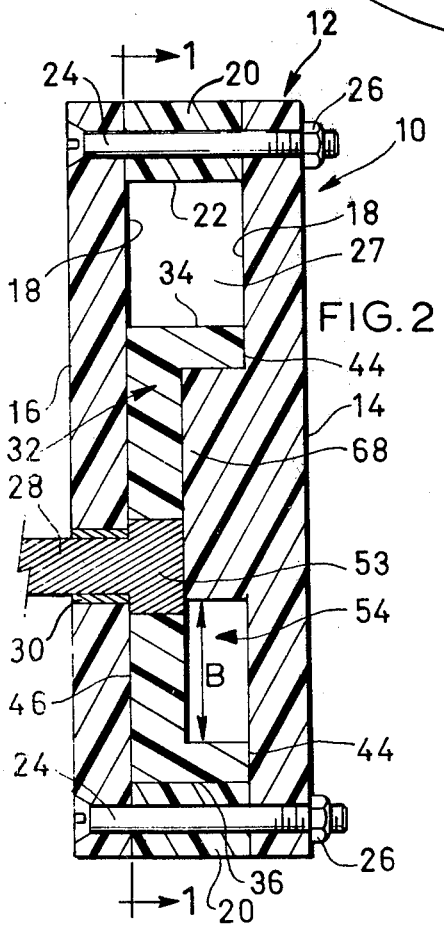
FIG. 2 is a transverse sectional view through the pump shown in FIG. 1 when taken as indicated by the arrows 2—2 of that figure.

Reference will first be made to FIGS. 1 and 2 of the accompanying drawings in which there is indicated generally at 10 one embodiment of a rotary machine in accordance with this invention. In the drawings, the machine 10 is shown as being in the form of a pump but other alternatives in accordance with this invention are equally possible.

The pump 10 comprises a casing generally indicated at 12 and comprising end walls 14 and 16 having mutually opposed spaced apart inner faces 18. The casing 12 also comprises an annular wall 20 having an inwardly facing surface 22. In the pump 10, the end walls 14 and 16 and the annular wall 20 of the casing 12 are shown as being secured together by bolts 24 and nuts 26. The configuration of the inner surface 22 will be considered in greater detail as the description herein proceeds.

The end walls 14 and 16 and the annular wall 20 of the casing 12 define a pump chamber generally indicated at 27.

The pump 10 also comprises a shaft 28 journalled in a bearing 30 in the end wall 16 as will readily be understood from FIG. 2. (It can of course extend through both end walls 14 and 16 if desired (FIG. 7)).

Within the pump chamber 27, there is provided a two-lobe lenticular rotor generally indicated at 32, having curved edge surfaces 34 and 36 defining mutually spaced apices 38 and 40. The rotor 32 is symmetrical about its centre line indicated at 42 and has mutually parallel side or end surfaces 44 and 46.

A generally rectangular elongated slot 48 having mutually parallel opposite sides 50 and 52 is formed centrally in the end surface 46 of the rotor 32. A rectangular drive plate 53 machined integrally with shaft 28, is disposed within the drive slot 48. On rotation of shaft 28, rotor 32 is driven round as will be described in greater detail herein-after.

In the other end surface 44 of the rotor 32, there is formed a second elongated slot 54 having mutually parallel sides 56 and 58 and having its longer dimension extending perpendicularly to the longer dimension of the aforementioned first slot 48. The slot 54 in this case has semi-circular end edges 60.

In the particular pump shown in FIGS. 1 and 2 of the accompanying drawings, the rotor 32 is shown as being formed as an integral unitary structure. It is, however, also possible to form it as a laminate from two planar members.

Rotation of shaft 28, and drive plate 53 will force rotor 32 to move around chamber 27 in an eccentric manner. Rotor 32 will slide on plate 53 along the length of slot 48.

In order to control movement of the lenticular rotor 32, a circular disc-like guide member 68 is fixedly located on the inner surface of one, or both, of end walls 14-16. In this embodiment the guide member 68 is formed integrally in one piece with the inner surface 18 of end wall 14. The guide member 68 is dimensioned to fit closely between side walls 58 of slot 54 of rotor 32. The semi circular ends of the slot 54 have a radius corresponding to the radius of the guide member 68, in this embodiment. In this way, as the rotor 32 rotates, the walls of slot 54 effectively move around member 68 in contact therewith, thereby controlling movement of rotor 32. In this way endwise movement of rotor 32 is prevented. The apices therefore cannot actually contract the wall surface 22. Suitable seals (not shown) in the apices will effect a seal at this point. Prevention of endwise sliding therefore ensures effective sealing action, without damage. It is equally possible for the guide member 68 to be separate member suitably secured to the end wall 14.

The pump 10 is also provided with an inlet opening 72 for the supply of fluid material into the pump chamber 27 and with an outlet opening 74 for the discharge of fluid material from the pump chamber 27.

Figure 3:
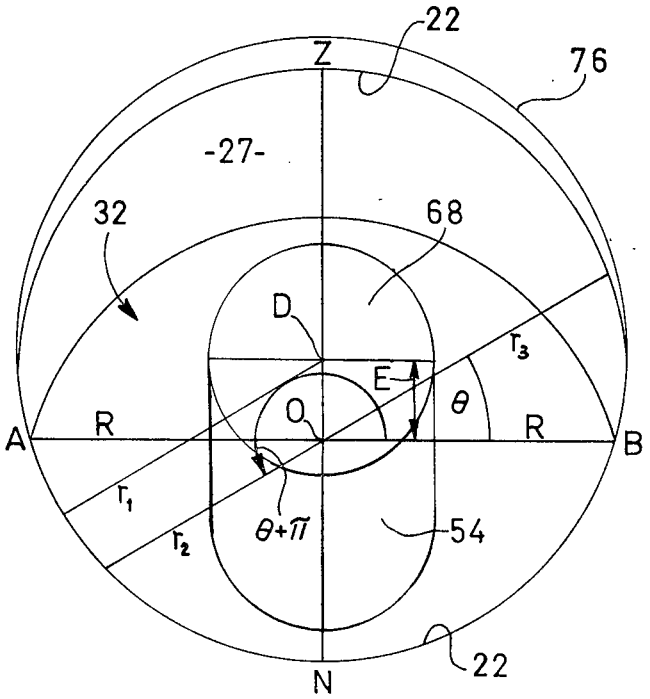
FIG. 3 is a schematic diagram illustrating the configuration of the internal surface of the annular wall of the chamber of the pump shown in FIGS. 1 and 2.

Reference will now be made to FIG. 3 for the purpose of providing a brief explanation of one form in accordance with this invention for the configuration of the inner surface 22 of the annular wall 20 of the casing 12. In FIG. 3, the point O represents the centre of the shaft 28 while the points A and B represent the apices 38 and 40 respectively of the rotor 32. The machine chamber 27 can be considered to be divided with the rotor 32 in the position shown into two parts by an imaginary base line AOB which defines, below that line, a lower chamber portion of minimum area and an upper chamber portion of maximum area. The base line AOB is bisected by the shaft axis centre O, into two lines of equal length R.

That portion of the surface 22 below the base line AOB as indicated at ANB is an arc of a circle 76 having a radius $r_1$ with the base line AOB being a chord of that circle 76.

The entire wall surface ANBZ is thus defined by the polar equation:

$$r_2 = \frac{E(R - E/2)\sin\theta}{(R - E)} + \left(\frac{E^2(R - E/2)^2\sin^2\theta}{(R - E)^2} + R^2\right)^{\frac{1}{2}}$$

wherein:

$r_2$ represents the length of a line extending from the centre of the machine shaft, i.e. from the point O, to a position of the circular arcuate portion ANB, when such line subtends an angle $(\theta+180°)$ with the base line AOB, i.e. for R as previously indicated represents half the length of the base line AOB; and E is a positive constant indicative of the eccentricity of the chamber wall surface 22 and equal to the distance between the point O and the point D at the centre of the disc-like guide member 68, the radius $r_1$ of the circle 76 being given by the following equation:

$$r_1 = \frac{(R^2 - R.E. + E^2/2)}{(R - E)}$$

That portion AZB of the surface 22 upwardly of the base line AOB where $0° - \theta - 180°$ is defined by the following polar equation:

$$r_3 = 2R - r_2$$

wherein $r_3$ represents the length of a line extending from the centre O of the machine shaft to a position on the surface 22 of the chamber wall upwardly of the base line AOB when such line subtends an angle $\theta$ with the base line for the corresponding value for $r_2$ for the angle $(\theta+180°)$.

The ratio R:E preferably has a value greater than 2:1.

The edge surfaces 34 and 36 of the rotor 32 have configurations each identical to the circular arcuate portion ANB of the chamber wall surface.

The disc-like guide member 68 has a radius such that at least a semi-circular part thereof is disposed within the second elongated slot 54 at all times during rotation of the rotor 32. To obtain such result, the centre of the guide member 68 which is the centre of eccentricity D, must not lie outside the edges 34, 36 of the rotor 32.

As explained above, the ends of the second slot 54 are normally semi-circular. It is however possible, for certain sets of dimensions, that the circular guide member 68 becomes so large that the slot 54 will be open at both ends.

During use of the rotary machine 10 as a pump, fluid material is inducted into the pump chamber 27 through the inlet opening 72 and is discharged from that chamber 27 through the discharge opening 74 on rotation of the shaft 28 and rotary movement of the rotor 32 in that pump chamber.

Figure 4:
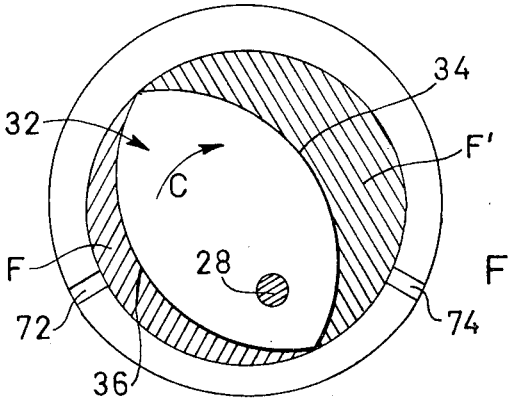
FIG. 4 is a schematic elevation similar to that of FIG. 1 but on a smaller scale and showing the rotor thereof rotated angularly clockwise from the position shown in FIG. 1.
Figure 5:
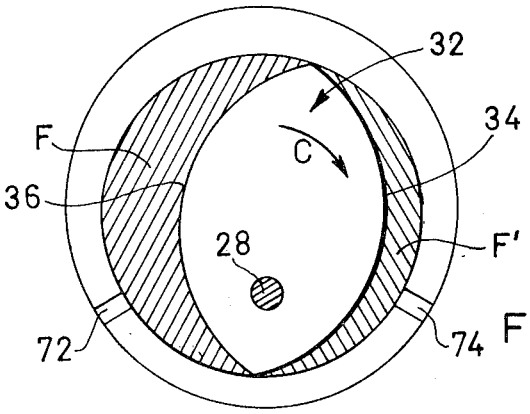
FIG. 5 is a schematic elevation similar to that of FIG. 4 but showing the rotor further rotated.

During such operation, as the rotor moves in the direction indicated by the arrows C, fluid material F is drawn through the inlet opening 72 into the space on the left hand side of the rotor 32 while fluid material $F^1$ (FIG. 4) previously inducted into the pump chamber 27 on the opposite side of the rotor is displaced from within that chamber 27 through the outlet 74. A subsequent stage in the rotor movement is shown in FIG. 5.

It is to be noted that, during such rotation of the rotor 32, the apices 38 and 40 thereof remain in precisely spaced relation, out of contact with the surface 22 of the annular wall 20 and as a result of it having a configuration as hereinbefore defined such spacing remains the same through its rotation. Seals (not shown) at such apices prevent leakage of fluid material therepast. It is to be noted however that such seals do not function to accommodate different spacings between such apices and the surface 22. The seals do not move or slide except to accommodate minute tolerances due to manufacturing deviations of the surface 22 from its intended configuration.

Seals (not shown) may also be provided between the flat end surfaces 44 and 46 of the rotor, and the end walls 14 and 16 of the chamber.

During rotation of the rotor 32, the rotor 32 moves longitudinally relative to the drive plate 53 so that such drive plate 53 effectively reciprocates in the drive slot 48. Simultaneously, the guide slot 54 rotates relative to the guide member 68 as indicated by arrow B moving tangentially thereabout. The provision of the fixed guide member 68 is especially adtantageous in that it controls movement of the 32 in a price orbital manner and has a relatively simple construction.

It will also be understood that the pump 10 can be operated by any suitable rotary power source (not shown). It is equally possible to provide a manually operated crank handle on one end of the shaft 28.

while it is possible for the internal surface 22 of the annular wall 20 of the casing of the pump 10 to have a configuration as hereinbefore specifically described, it is also possible in accordance with this invention for such surface to be entirely cardioidal. Such an alternative surface configuration will now be described with reference to FIG. 6 of the accompanying drawings.

In that figure, there is indicated at 75 the inner surface of an annular wall of another embodiment of a rotary machine in accordance with this invention, the centre of the rotor shaft being indicated by the letter O.

The inner surface 75 is, in this embodiment, entirely cardioidal and is defined by either of the following equations:

$$r=E(\sin\theta)^n+R$$

and $$r=(R+E)-E(\cos\theta)^n$$

wherein:

r represents the length of a line extending from the point O to any point on the surface 75 and which line subtends an angle $\theta$ with the line AOB;

R has a value equal to half the length of the rotor;

n represents a positive constant; and

E represents a positive constant indicative of the inner surface of the eccentricity of the wall and equal to the distance between the centre O of the shaft and the centre of the disc-like guide member.

Figure 6:
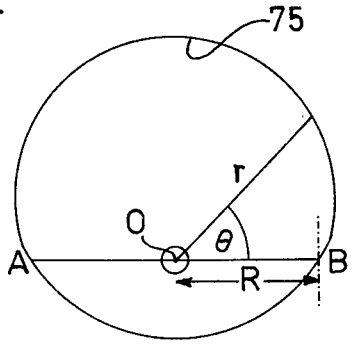
FIG. 6 is a schematic diagram illustrating the configuration of the internal surface of the annular wall of the chamber of an alternative embodiment of a rotary machine in accordance with this invention.

For the position of the rotor shown in FIG. 6, the line AOB represents an imaginary base line extending through the central axis of the shaft, from one side to the other of the chamber, and being of equal lengths (R) on both sides of the shaft. Such base line defines a lower chamber portion of minimum area and an upper chamber portion of maximum area.

The surface 75 is in the form of a cardioid or limacon. As was the case for the configuration previously described, each of the edge surfaces of the rotor will be essentially identical to the shorter portion of the surface 75 between the points A and B in FIG. 6.

Figure 7:
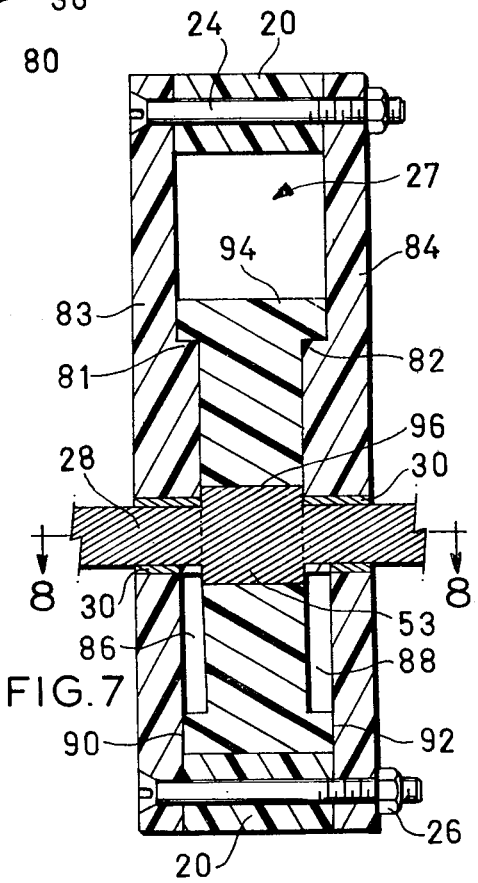
FIG. 7 is a transverse sectional view similar to that of FIG. 2 but showing an alternative embodiment of a pump in accordance with this invention.
Figure 8:
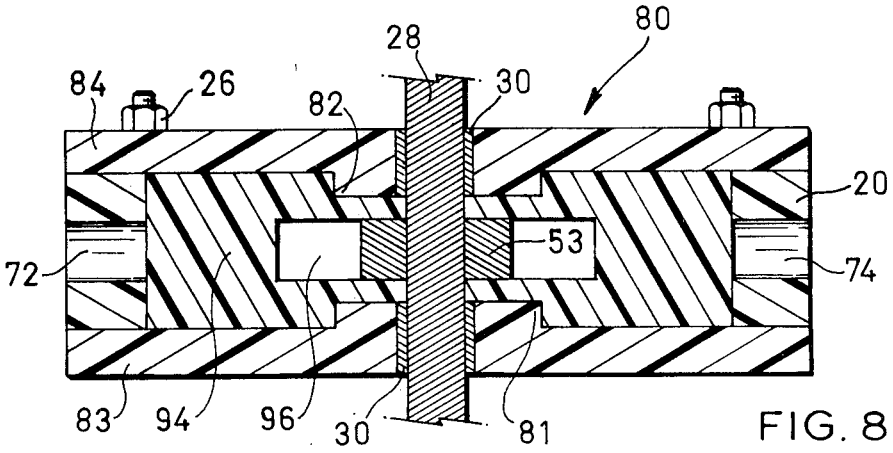
FIG. 8 is a sectional view through the pump shown in FIG. 7 when taken as indicated by the arrows 8—8 of that figure, and, FIG. 9 is a schematic side elevation corresponding to FIG. 1, showing an alternate embodiment.

Reference will now briefly be made herein to FIGS. 7 and 8 of the accompanying drawings in which there is shown generally at 80 an alternative embodiment of a pump in accordance with this invention. Since the pump 80 is similar in many ways in its construction to the pump 10, identical component parts of the two pumps are identified by the same legends.

The pump 80 differs from the pump 10 in that it is provided with two fixed circular guide members 81 and 82 corresponding to the guide member 68, which are integrally formed with respective ones of the end walls 83 and 84 of the pump casing and which are received in corresponding and mutually parallel second guide slots 86 and 88 corresponding to the guide slot 54 and formed in the side surfaces 90 and 92 of the rotor 94.

A drive slot 96, perpendicular to the slots 86 and 88 is formed within the rotor 94 for receiving the drive plate 53 on the pump shaft 28 (FIG. 7).

During operation of the pump 76, the fixed guide members 81 and 82 effectively reciprocate in respective ones of the slots 86 and 88 and the guide member 53 effectively reciprocates in the slot 96 in the same manner as the guide members 53 and 68 of the pump 10 effectively reciprocate in respective ones of the slots 48 and 54. The drive plate could equally be provided with anti-friction means such as rollers or the like to reduce wear if necessary.

Figure 9:
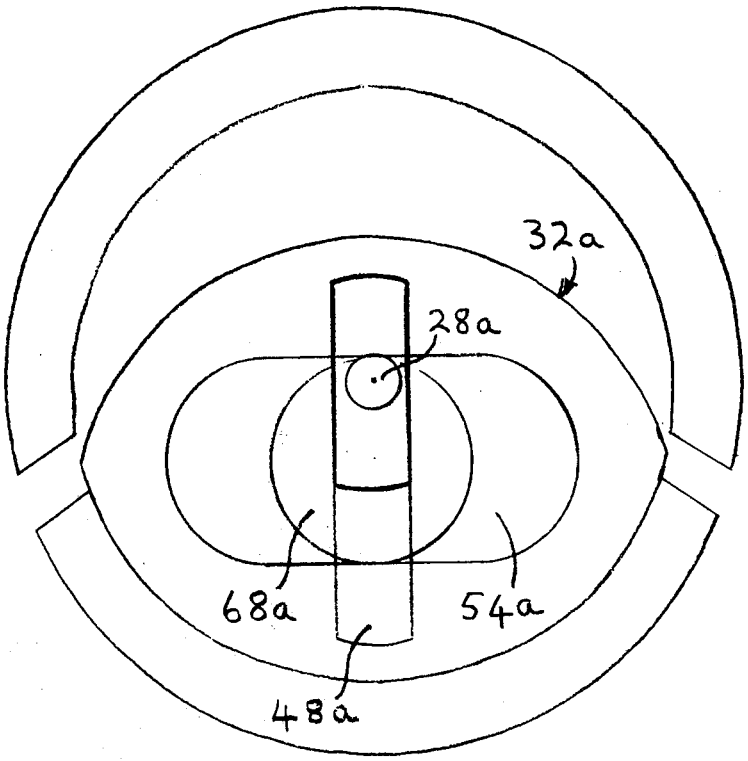

The invention may also be constructed in the manner shown in FIG. 9. In this embodiment, the centres of the shaft 28*a*, and guide 68*a* have been exchanged, while the shape of the chamber and walls remains the same.

In addition, the guide recess 54*a* has been swung 90° so that instead of lying on an axis transversely to rotor 32*a*, it now lies on a longitudinal axis.

Likewise, the drive slot or recess 48*a* has been swung 90° and now runs transversely, instead of longitudinally.

The remaining components remain the same as in FIG. 1.

This layout has certain advantages in some cases. For example, when using the invention as a so-called "air motor", receiving air and converting it into rotary motion, somewhat mor torque is developed than in the case of FIG. 1. This is due to the improved mechanical advantage achieved between the rotor 32*a* and shaft 28*a* in this case.

While the invention has hereinbefore been specifically described with reference to the particular embodiments thereof as shown in the accompanying drawings, it should be understood that numerous variations in and modifications of the described structure are possible within the scope of this invention. For example, while the invention has been specifically described with particular reference to the provision of a rotary machine intended to be used as a pump, such a rotary machine can also be constructed, for example, for use as a compressor, a fluid motor or a combustion engine.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. In a rotary machine of the type having a chamber with an annular wall having at least in part a cardioidal configuration, and a shaft extending into said chamber and having an acircular portion having mutually parallel and linear opposite edges, and mutually spaced inlet and outlet ports opening into said chamber for the supply and discharge respectively of a fluid material, the improvement comprising;

a two-lobe lenticular rotor with symmetrically opposed apices and disposed within said chamber for eccentric rotation therein with said apices in sliding sealing contact with said annular wall, said rotor being provided with a first elongated slot having opposite sides within which said acircular portion of said shaft is slidingly disposed for driving reciprocating movement therewithin on rotation of said shaft and with a second elongated slot being further provided in an end surface thereof, having parallel opposite sides and perpendicular to said first elongated slot, and a fixed circular guide member within said chamber extending into said second elongated slot within said rotor so that, on rotation of said rotor within said chamber, said opposite sides of said second elongated slot move tangentially around said guide member in response to relative reciprocating movement of said guide member along said second elongated slot with at least a semi-circular part of said circular guide member remaining within said second elongated slot at all times during such rotation of said rotor, said guide member having a predetermined diameter larger than said shaft, and located with its centre offset relative to the centre of said shaft, the relative diameters of said shaft and said guide members being such that said shaft lies within the circumstances of said guide member.

2. In a rotary machine of the type described in claim 1, the improvement comprising forming said first elongated slot in one end wall of said rotor, and forming said second elongated slot in the other end wall of said rotor.

3. In a rotary machine of the type described in claim 1, the improvement comprising two said second elongated slots, one being formed in each end wall of said rotor, and wherein said first elongated slot is formed in a median portion of said rotor located between said two second elongated slots.

4. In a rotary machine of the type described in claim 1, the improvement comprising forming said first elongated slot on an axis corresponding to the longitudinal axis of said rotor.

5. In a rotary machine of the type described in claim 1, the improvement comprising forming said first elongated slot on an axis line transverse to the longitudinal axis of said rotor.

6. A rotary machine which comprises:

a casing including a chamber defined by axially spaced apart end walls and a single lobe annular wall within an inner surface having at least in part a cardioidal configuration;

a shaft extending into said chamber, rotatably mounted in at least one of said end walls and comprising, within said chamber, an acircular portion having mutually parallel and linear opposite edges, said shaft having a predetermined diameter;

a two-lobe lenticular rotor with symmetrically opposed apices and disposed within said chamber for eccentric rotation therein with said apices in sliding sealing contact with said inner surface of said annular wall, said rotor being provided with a first elongated slot having opposite sides within which said acircular portion of said shaft is slidingly disposed for driving reciprocating movement therewithin on rotation of sais shaft and, in an end surface thereof, and said rotor being provided with a second elongated slot having parallel opposite sides and perpendicular to said first elongated slot;

a fixed circular guide member on the inner face of a said end wall of said casing and extending into said second elongated slot within said rotor so that, on rotation of said rotor within said chamber, said opposite sides of said second elongated slot move tangentially around said guide member in response to relative reciprocating movement of said guide member along said second elongated slot with at least a semi-circular part of said circular guide member remaining within said second elongated slot at all times during such rotation of said rotor, said guide member having a predetermined diameter larger than said shaft, and located with its centre offset relative to the centre of said shaft, the relative diameters of said shaft and said guide members being such that said shaft lies within the circumference of said guide member, and, mutually spaced inlet and outlet ports opening into said chamber for the supply and discharge respectively of a fluid material.

7. A rotary machine as claimed in claim 1 and in which said fixed circular guide member is integrally formed with a respective one of said end walls of said casing.

8. A rotary machine as claimed in claim 1 and in which each of said first and second elongated slots has a generally rectangular configuration.

9. A rotary machine as claimed in claim 1 wherein said shaft passes through said guide member.

10. A rotary machine as claimed in claim 1 wherein the axis of said first slot lies on the longitudinal axis of said rotor.

11. A rotary machine as claimed in claim 1 wherein the axis of said first slot lies normal to the longitudinal axis of said rotor.

12. A rotary machine as claimed in claim 1 and which comprises two said fixed circular guide members on the inner faces of respective ones of said end walls of said casing and extending into two mutually parallel said second elongated slots provided in said rotor in opposite end surfaces thereof.

13. A rotary machine as claimed in claim 12 wherein said shaft passes through both said guide members and is journalled in both end walls, on opposite sides of said rotor.

14. A rotary machine as claimed in claim 1 and in which said inner surface of said annular wall of said casing is defined by a polar equation selected from the following equations:

$$r=E(\sin\theta)^n+R, \text{ and}$$

$$r=(R+E)-E(\cos\theta)^n,$$

wherein:

r represents the length of a line extending from the centre of said shaft to a position on said inner surface of said annular wall when such line subtends an angle $\theta$ with an imaginary base line extending through such centre of said shaft and defining a maximum area on one side of said base line and a minimum area on the other side of said base line between said base line and said inner surface of said annular wall;

n represents a positive constant;

E represents a positive constant indicative of the eccentricity of said inner surface of said annular wall and equal to the distance between the centre of said circular guide member; and R represents half the length of said rotor between said apices thereof.

15. A rotary machine as claimed in claim 14 and in which n has a value of 1.0.

16. A rotary machine as claimed in claim 15 and in which the ratio R:E has a value of greater than 2:1.

17. A rotary machine as claimed in claim 1, in which said inner surface of said annular wall of said casing comprises a circular arc portion having a radius $r_1$ and extending between the ends of an imaginary base line extending through the centre of said shaft and defining a minimum area on one side of said base line and a maximum area on the other side of said base line between said base line and said inner surface of said annular wall, and in which said inner surface of said annular wall of said casing on the opposite side of said base line to said circular arc portion is defined by the polar equation:

$$r_3=2R-r_2$$

wherein:

$r_3$ represents the length of a line extending from said centre of said shaft to a position on said inner surface of said annular wall on a side of said base line opposite to said circular arc portion when such line subtends an angle $\theta$ with said base line, and $r_2$ represents the absolute value of the length of a line extending from said centre of said shaft to a position on said circular arc portion of said inner surface of said annular wall when such last-mentioned line subtends an angle of $(180°+\theta)$ with said base line, said parameters $r_1$, $r_2$ and $r_3$ being related by the following equations:

$$r_1 = \frac{R^2 - R.E. + E^2/2}{(R - E)}\text{; and}$$

-continued $$r_2 = \frac{E(R - E/2) \cdot \sin\theta}{(R - E)} + \left(\frac{E^2(R - E/2)^2 \sin^2}{(R - E)^2} + R^2\right)^{\frac{1}{2}}$$

wherein:

E represents a positive constant indicative of the eccentricity of said inner surface of said annular wall on the opposite side of said base line to said circular arc portion and equal to the distance between the centre of said shaft and the centre of said circular guide member; and R represents half the length of said rotor between said apices thereof.

18. A rotary machine as claimed in claim 17 and in which the ratio R:E has a value greater than 2:1.

* * * * *